US008267441B2

(12) United States Patent
Lin

(10) Patent No.: US 8,267,441 B2
(45) Date of Patent: Sep. 18, 2012

(54) OPERATING DEVICE FOR LOCK

(75) Inventor: Hsi-Ting Lin, Guiren Township, Tainan County (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 369 days.

(21) Appl. No.: 12/702,361

(22) Filed: Feb. 9, 2010

(65) Prior Publication Data

US 2011/0192201 A1 Aug. 11, 2011

(51) Int. Cl.
*E05B 65/10* (2006.01)

(52) U.S. Cl. ..... 292/92; 292/21; 292/DIG. 65

(58) Field of Classification Search ..... 292/92, 292/21, DIG. 65, 336.3
See application file for complete search history.

(56) References Cited

U.S. PATENT DOCUMENTS

| | | | | | |
|---|---|---|---|---|---|
| 4,741,563 | A * | 5/1988 | Cohrs | 292/21 |
| 4,961,330 | A | 10/1990 | Evans | 292/21 |
| 4,974,890 | A * | 12/1990 | Cohrs | 292/336.3 |
| 5,520,427 | A | 5/1996 | Mader | 292/336.3 |
| 5,564,760 | A | 10/1996 | Mader | 292/182 |
| 5,566,994 | A | 10/1996 | Mader | 292/336.3 |
| 5,570,916 | A | 11/1996 | Mader | 292/336.3 |
| 7,364,212 | B1 | 4/2008 | Fan | 292/336.3 |
| 7,887,107 | B2 * | 2/2011 | Shen | 292/92 |
| 8,011,702 | B2 * | 9/2011 | Tien et al. | 292/336.3 |
| 8,042,843 | B2 * | 10/2011 | Tien | 292/92 |
| 2010/0043505 | A1 * | 2/2010 | Tien | 70/92 |
| 2010/0066102 | A1 * | 3/2010 | Shen | 292/92 |
| 2010/0117376 | A1 * | 5/2010 | Shen | 292/92 |
| 2011/0239712 | A1 * | 10/2011 | Tien | 70/92 |

* cited by examiner

*Primary Examiner* — Carlos Lugo
*Assistant Examiner* — Mark Williams
(74) *Attorney, Agent, or Firm* — Alan Kamrath; Kamrath IP Lawfirm, PA

(57) ABSTRACT

An operating device for a lock includes a mounting plate mounted to an outer side of a door. A frame is fixed in a receiving space of the door. A push member includes a push section operably connected to a latch. The push member further includes a pivotal section having a pivot hole and a sliding groove. A first pivot extends through the pivot hole of the pivotal section and the frame. A second pivot extends through the frame and is slideably received in the sliding groove of the pivotal section. A lever includes a lug received in the receiving space. The lug has a pin hole through which the second pivot extends. When the lever pivots from an upper position to a lower position about a pivot axis defined by the second pivot, the push member pivots about a pivot axis defined by the first pivot for unlocking operation.

6 Claims, 11 Drawing Sheets

OPERATING DEVICE FOR LOCK

BACKGROUND OF THE INVENTION

The present invention relates to an operating device for a lock and, more particularly, to an operating device for a panic exit door lock that can be operated from an outer side of a door.

Locks for panic exit doors are widely utilized in panic exits and passageways in apartments, buildings, etc. To allow easy opening of the panic exit door in the case of emergency such as fire, an operating device with a larger operating surface is mounted to a side of the door for easily and rapidly unlocking the lock. Various operating devices have been developed according to differing user needs.

FIG. 11 shows a panic exit door lock 144 mounted to an inner side 140 of a door 136 and an operating device 152 mounted to an outer side 138 of door 136. A receiving space 142 extends from inner side 140 through outer side 138 of door 136. Panic exit door lock 144 includes a base 146 fixed to inner side 140 of door 136. A slide 148 is slideably mounted on base 146. A latch 150 is pivotably mounted to base 146 and operably connected to slide 148, such that movement of slide 148 causes movement of latch 150 between an extended, locking position and a retracted, unlocking position.

Operating device 152 includes a mounting plate 154 fixed to outer side 138 of door 136. A handle 156 is fixed to an outer face of mounting plate 154. A frame 158 is mounted to an inner face of mounting plate 154 and received in receiving space 142. Frame 158 includes two sidewalls 160 between which a lever 162 is pivotably mounted. Specifically, lever 162 includes a first end 164 outside of door 136, a second end 166 extending out of receiving space 142 and abutting slide 148, and an intermediate section 168 intermediate first and second ends 164 and 166 and pivotably mounted between sidewalls 160 of frame 158. A spacing D1 between a pivot axis of lever 162 to the force applying point at first end 164 of lever 162 is generally smaller than a spacing D2 between the pivot axis of lever 162 to the contact point between slide 148 and second end 166 of lever 162, such that a smaller displacement of lever 162 causes a longer displacement of slide 148 for unlocking purposes. However, a user has to apply a large force to move slide 148, which is not labor-saving while operating lever 162. On the other hand, spacing D1 can be made larger than spacing D2 to obtain a force-saving effect. However, reduction of spacing D2 is difficult, because spacing D2 must be large enough so that second end 166 of lever 162 can abut slide 148. Namely, lever 162 must protrude out of door 136 to a large extent for obtaining the force-saving effect without reducing spacing D2, leading to inconvenient operation of lever 162. Furthermore, lever 162 may be inadvertently impinged.

Thus, a need exists for an operating device for a lock that allows easy unlocking operation with less effort and without the risk of inadvertent operation.

BRIEF SUMMARY OF THE INVENTION

The present invention solves this need and other problems in the field of operating devices of locks for panic exit doors by providing, in a preferred form, an operating device for a lock including a mounting plate having inner and outer faces spaced from each other along a first axis. A window extends from the inner face through the outer face of the mounting plate along the first axis. The mounting plate is adapted to be mounted to an outer side of a door. A receiving space extends from an inner side of the door through the outer side of the door and has an outer end covered by the mounting plate. The window is aligned with and in communication with the receiving space. A frame is adapted to be received in the receiving space of the door. The frame includes two first sidewalls spaced along a second axis perpendicular to the first axis. The frame further includes a second sidewall extending between the two first sidewalls. The second sidewall of the frame is fixed to the inner face of the mounting plate. The two first sidewalls include two aligned first holes and two aligned second holes, with each of the two aligned second holes spaced from one of the two aligned first holes along a third axis perpendicular to the first and second axes. A push member includes a push section and a pivotal section spaced from the push section along the first axis. The pivotal section includes a pivot hole aligned with the two first holes. The pivotal section further includes a sliding groove aligned with the two second holes. The sliding groove includes first and second ends spaced from each other along the first axis. An actuating pin is mounted to the pivotal section and spaced from the sliding groove along the third axis. The actuating pin is intermediate the two first sidewalls of the frame. A first pivot extends through the two first holes and the pivot hole. A second pivot extends through the two second holes and the sliding groove and movable between the first and second ends of the sliding groove. The push section extends out of the receiving space and is adapted to be operably connected to a latch movable between an extended, locking position not allowing opening of the door and a retracted, unlocking position allowing opening of the door. The push member is pivotable between first and second positions about a first pivot axis defined by the first pivot. The second pivot is in the first end of the sliding groove when the pushing member is in the first position. The second pivot is in the second end of the sliding groove when the push member is in the second position. A lever includes first and second ends. A lug is formed on the second end of the lever and extends through the window into the receiving space of the door. The lug includes a first pin hole. The second pivot extends through the first pin hole, allowing pivotal movement of the lever between an upper position and a lower position about a second axis defined by the second pivot. The lever is operably connected to the actuating pin, such that pivotal movement of the lever causes movement of the push member.

When the lever moves from the upper position to the lower position, the actuating pin drives the push member to pivot from the first position to the second position when the lever is pivoted from the upper position to the lower position, and the push section operates to move the latch from the extended, locking position to the retracted, unlocking position.

In the most preferred form shown, the push member includes first and second lateral walls spaced from each other along the second axis. Each of the first and second lateral walls includes first and second ends spaced from each other along the first axis. The push member further includes an interconnecting wall between the first ends of the first and second lateral walls, defining a space between the interconnecting wall and the first ends of the first and second lateral walls. The first ends of the first and second lateral walls form the pivotal section, and the second ends of the first and second lateral walls form the push section. The first end of each of the first and second lateral walls includes the pivot hole and the sliding groove. The first ends of the first and second lateral walls include two aligned actuating pin holes. The sliding groove of the first end of each of the first and second lateral walls is intermediate the pivot hole and the actuating pin hole of the first end of one of the first and second lateral walls along the third axis. The actuating pin has two ends received in the two actuating pin holes. The lug of the lever includes a second pin hole through which the actuating pin extends. The second sidewall of the frame includes an opening aligned with the window. The lug of the lever extends through the opening into the space of the push member. The second pivot axis defined by the second pivot has a first spacing to the first end of the lever. The second pivot axis has a second spacing to a center of the second pin hole. The first pivot axis defined by the first pivot has a third spacing to the center of the second pin hole. The first pivot axis has a fourth spacing to the push section. The second spacing is smaller than the third spacing, which is smaller than the first spacing, which, in turn, is smaller than the fourth spacing.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
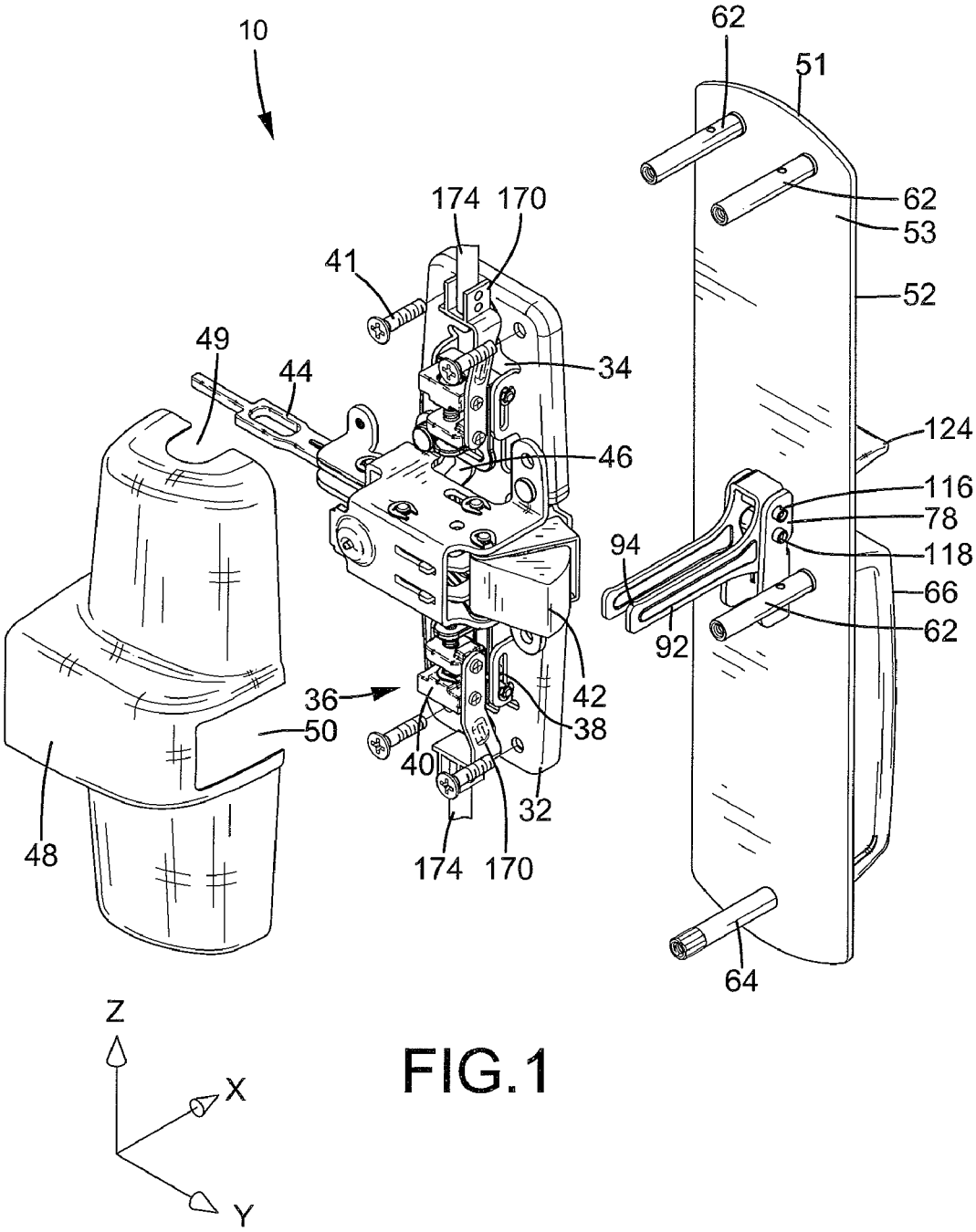
FIG. 1 shows an exploded, perspective view of an operating device for a panic exit door according to the preferred teachings of the present invention.
Figure 2:
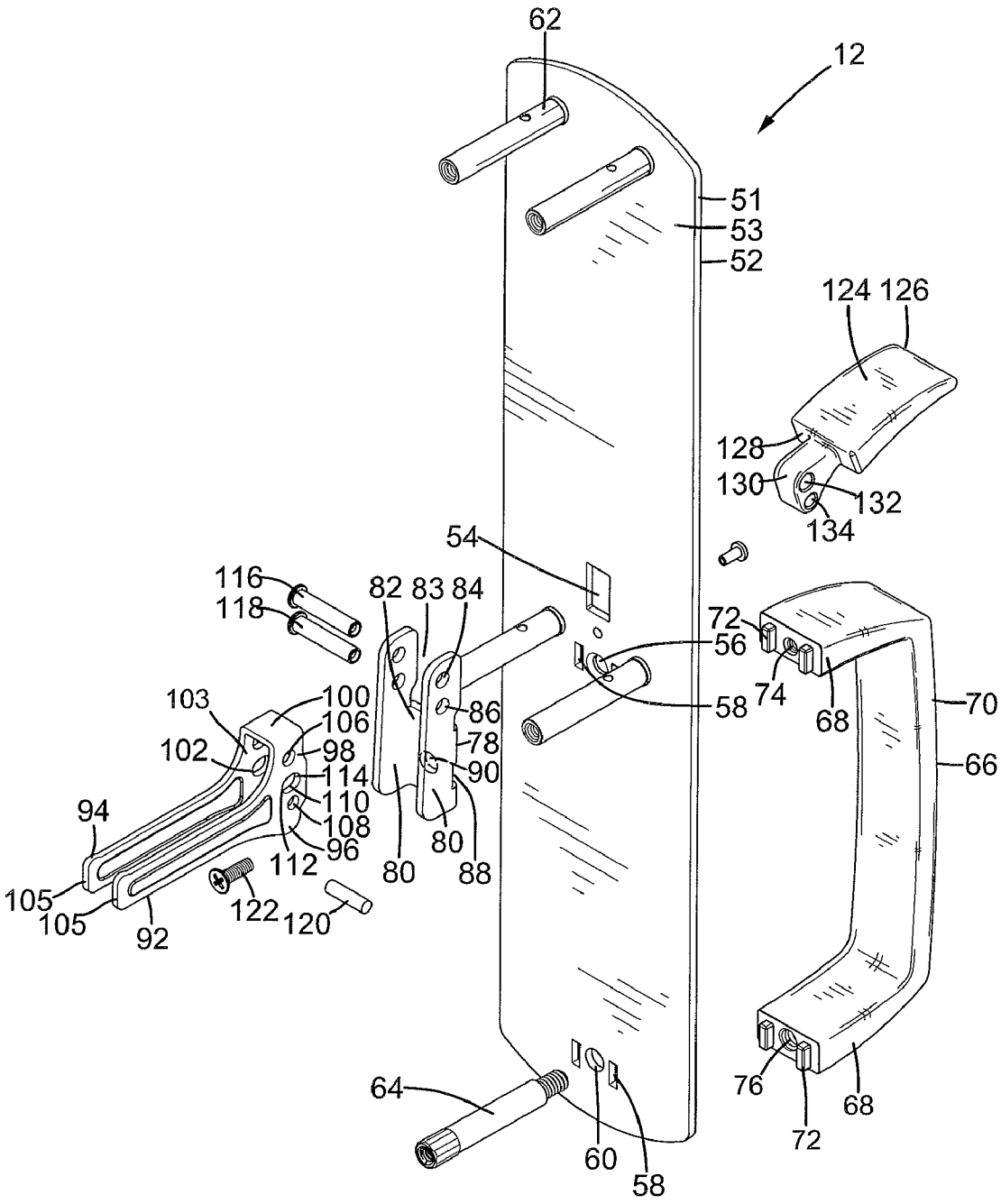
FIG. 2 shows a partial, exploded, perspective view of the operating device of FIG. 1.
Figure 3:
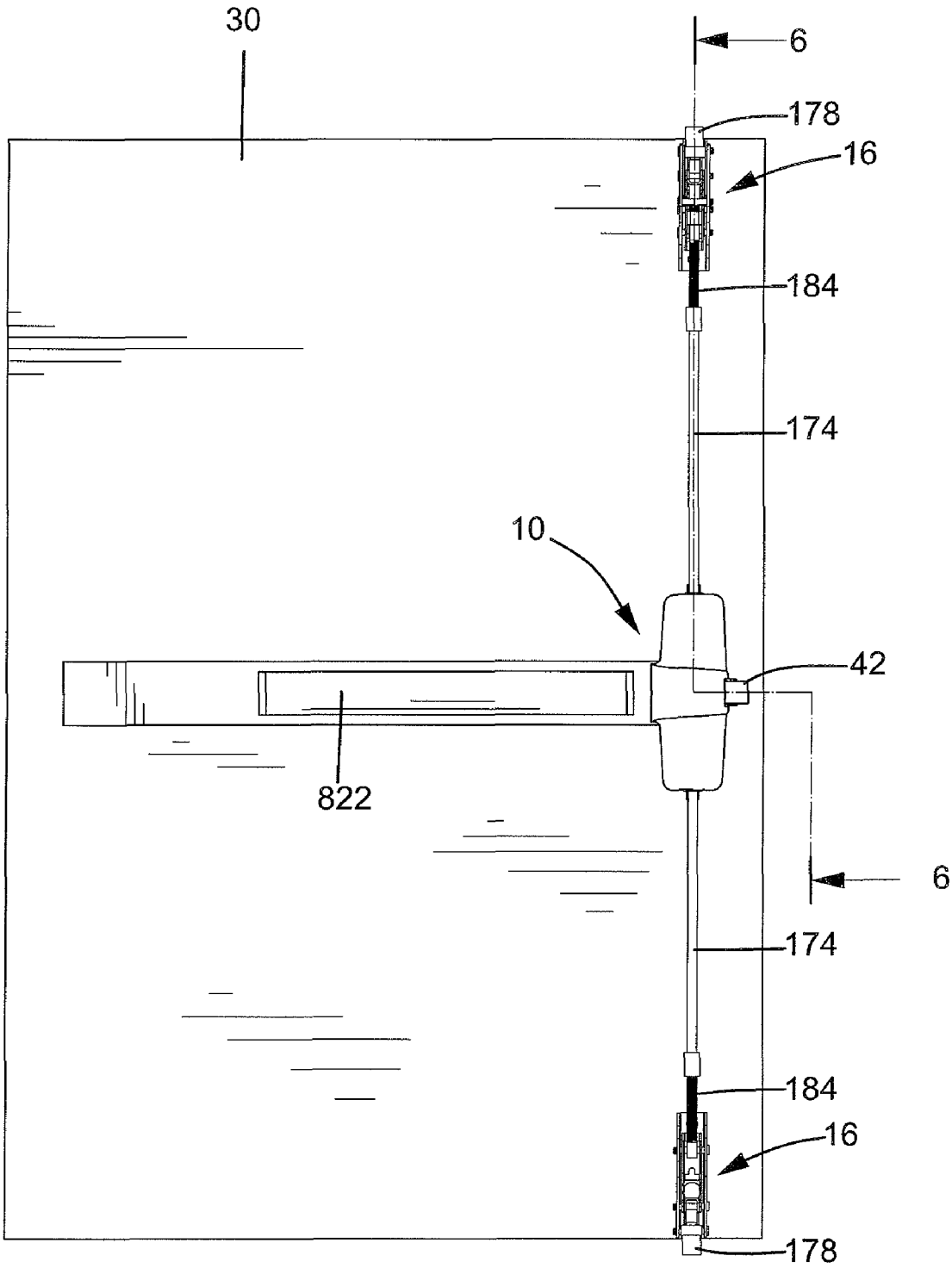
FIG. 3 shows a side view of a panic exit door and a lock utilizing the operating device of FIG. 1.
Figure 4:
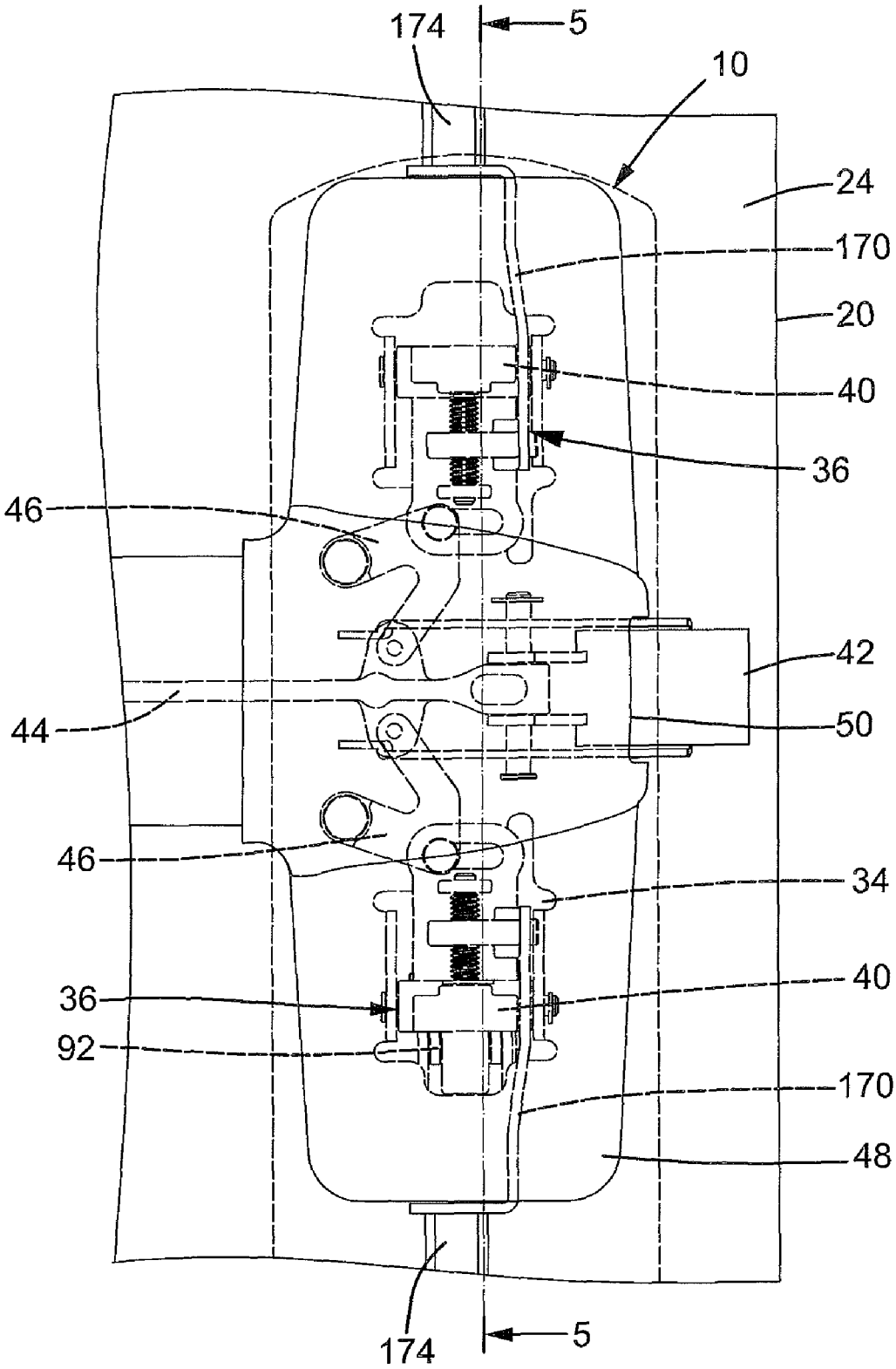
FIG. 4 shows an enlarged view of a portion of the panic exit door and the lock of FIG. 3.
Figure 5:
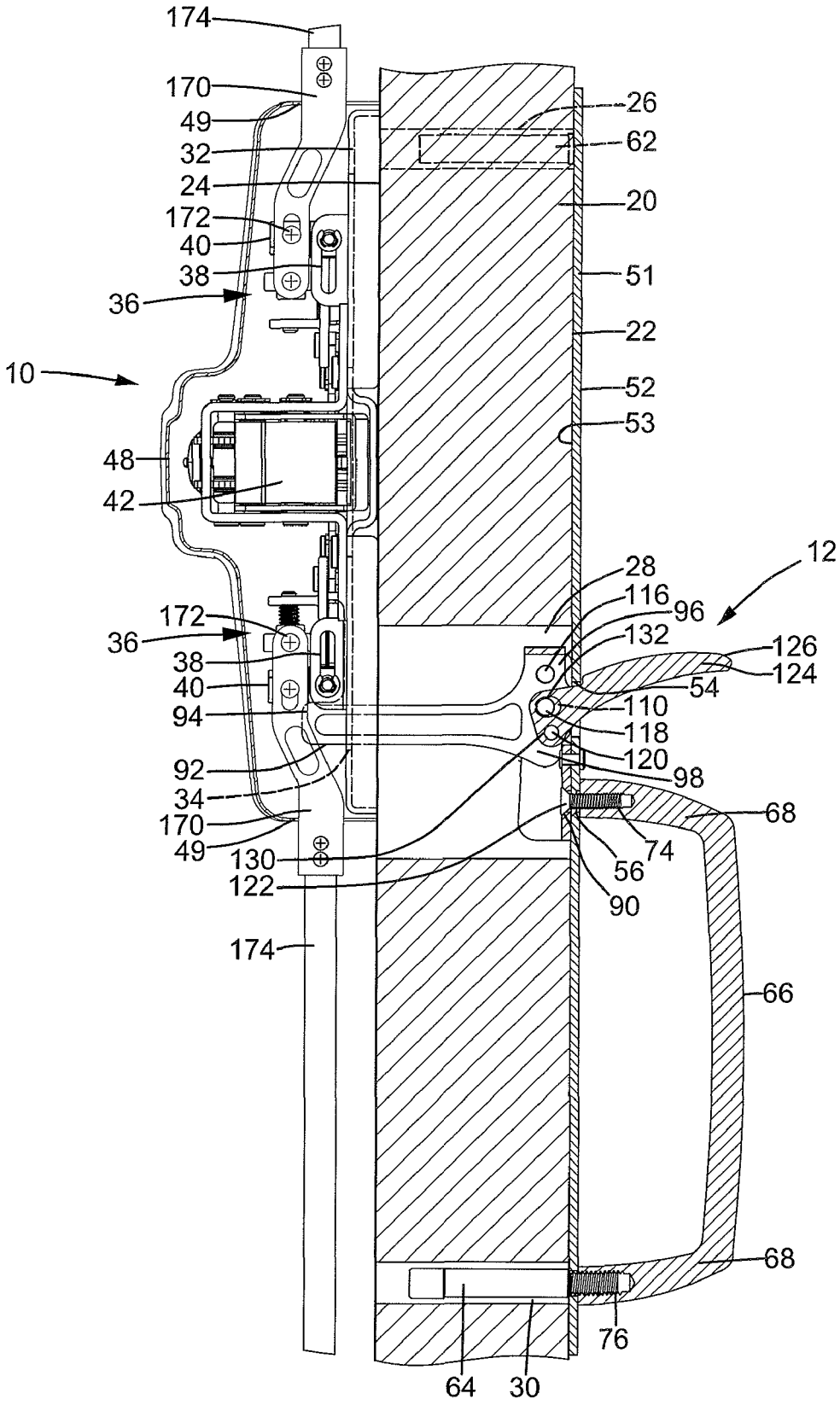
FIG. 5 shows a partial, cross sectional view of the panic exit door and the lock of FIG. 3 according to section line 5-5 of FIG. 4.
Figure 6:
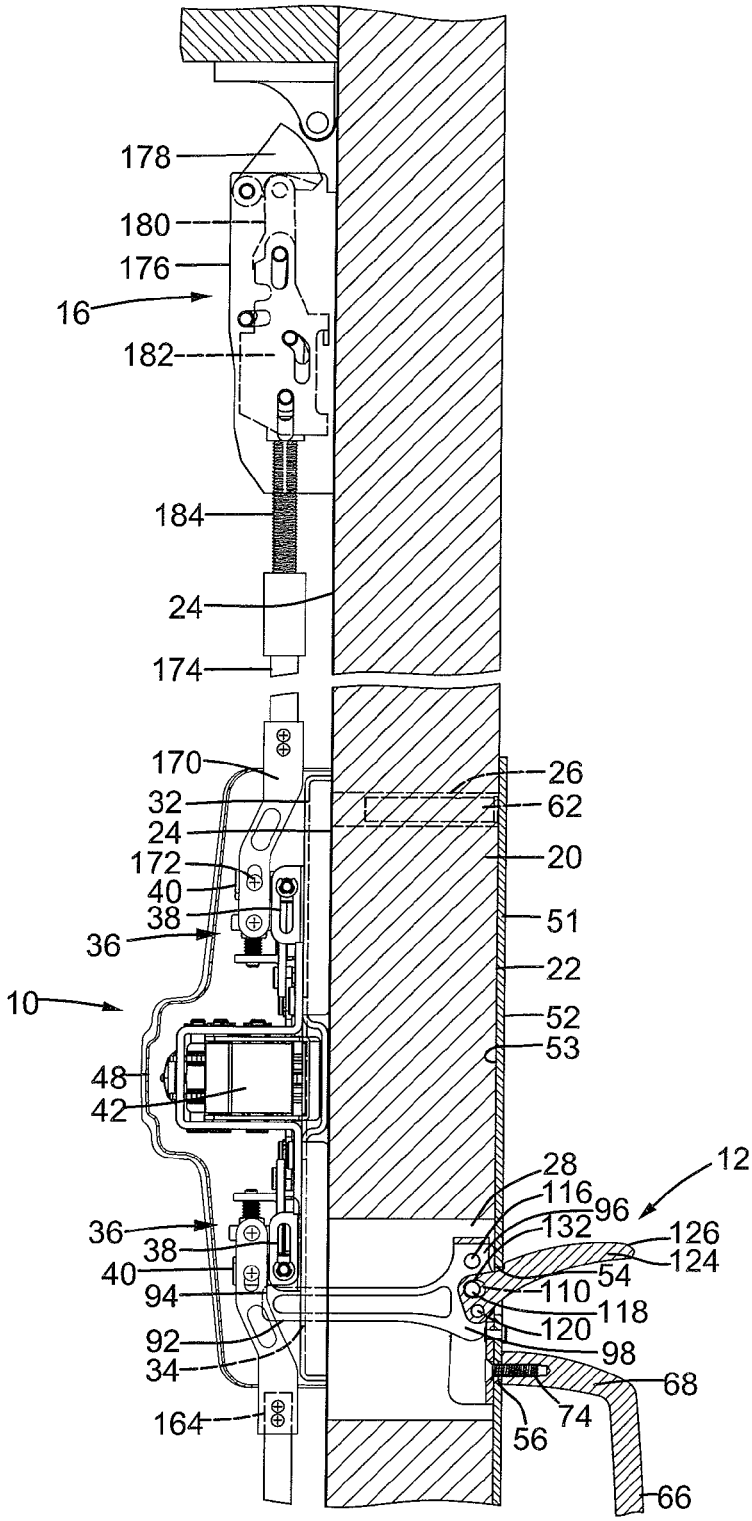
FIG. 6 shows a partial, cross sectional view of the panic exit door and the lock of FIG. 3 according to section line 6-6 of FIG. 3.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "upper", "lower", "inner", "outer", "end", "portion", "section", "lateral", "vertical", "spacing", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

An operating device according to the preferred teachings of the present invention is shown in the drawings and generally designated 12. Operating device 12 is generally utilized with a lock mounted to a panic exit door 20. According to the preferred form shown, door 20 includes inner and outer sides 24 and 22 spaced along a first axis X. Door 20 further includes four positioning holes 26, a receiving space 28, and a fixing hole 30, all of which extending from inner side 24 through outer side 22.

According to the preferred form shown, the lock includes a linking device 10 mounted to inner side 24 of door 20 and includes a base 32 having two slots 34. Two guiding mechanisms 36 are provided on base 32, with each guiding mechanism 36 including a pair of tracks 38 between which a slide 40 is slideably mounted. The lock further includes a linking rod 44 and two links 46. Linking rod 44 is slideable relative to base 32 along a second axis Y perpendicular to first axis X. Each link 46 is pivotably connected between linking rod 44 and one of slides 40, such that movement of link 46 along second axis Y causes movement of slides 40 along a third axis Z perpendicular to first and second axes X and Y. Third axis Z extends in a vertical direction in the most preferred form shown. The lock further includes a latch 42 pivotably mounted to linking rod 44 and base 32, such that movement of linking rod 44 along second axis Y causes movement of linking rod 44 between an extended, locking position and a retracted, unlocking position. Lock further includes top and bottom latch devices 16 each having a body 176, a latch 178 pivotably connected to body 176, a follower 182 slideably mounted in body 176 along third axis Z, and a linking member 180 having a first end coupled to follower 182 and a second end coupled to latch 178. Follower 182 of each of top and bottom latch devices 16 is coupled to a screw rod 184 that can be moved to move latch 178 between an extended, locking position and a retracted, unlocking position. An end of a connecting rod 174 is fixed to a connecting member 170 fixed by screws 172 to one of slides 40. The other end of connecting rod 174 is coupled to one of screw rods 184. Thus, movement of linking rod 44 along second axis Y causes movement of each latch 178 between an extended, locking position and a retracted, unlocking position. A cover 48 is provided to shield the lock and includes notches 49 and 50 allowing passage of latches 42 and 178. An example of the lock including latches 178, slides 40, and linking rod 44 is disclosed in U.S. Patent Publication No. US 2010/0066102 A1, the entire contents of which are incorporated herein by reference. Furthermore, top and bottom latch devices 16 can be of concealed type, with an example of which disclosed in U.S. Pat. No. 7,748,757, the entire contents of which are incorporated herein by reference.

According to the preferred form shown, operating device 12 according to the preferred teachings of the present invention includes a mounting plate 51 having inner and outer faces 53 and 52 spaced along first axis X. A window 54 is formed in an intermediate portion of mounting plate 51 and extends from inner face 53 through outer face 52 of mounting plate 51. Window 54 is non-circular in cross section and is rectangular in cross section in the most preferred form shown. Mounting plate 51 further includes a through-hole 56 extending from inner face 53 through outer face 52 and spaced from and below window 54 along third axis Z. A fixing hole 60 is formed in a lower end of mounting plate 51. Two engaging slots 58 are located on opposite sides of each of through-hole 56 and fixing hole 60 and spaced along second axis Y. Furthermore, engaging slots 58 on opposite sides of through-hole 56 are spaced from engaging slots 58 on opposite sides of through-hole 56 along third axis Z. Each engaging slot 58 is non-circular in cross section and is rectangular in cross section in the most preferred form shown. Four posts 62 are provided on inner face 53 of mounting plate 51. Mounting plate 51 is mounted to outer side 22 of door 20 with posts 62 received in positioning holes 26 of door 20, with an outer end of receiving space 28 of door 20 covered by mounting plate 51, and with window 54 aligned with and in communication with receiving space 28. Screws 41 are extended through base 32 into posts 62. Thus, mounting plate 51 and base 32 are respectively fixed to outer and inner sides 22 and 24 of door 20.

According to the preferred form shown, operating device 12 further includes a frame 78 received in receiving space 28 of door 20. Frame 78 includes two first sidewalls 80 spaced along second axis Y and a second sidewall 82 interconnecting first sidewalls 80. Second sidewall 82 of frame 78 is fixed to inner face 53 of mounting plate 51. First sidewalls 80 include two aligned first holes 84 and two aligned second holes 86 each spaced from one of first holes 84 along third axis Z. In the most preferred form shown, second sidewall 82 of frame 78 includes an opening 83 in an upper end thereof and two recesses 88 in a lower end thereof. Furthermore, a hole 90 is formed between recesses 88.

According to the preferred form shown, operating device 12 further includes a handle 66 mounted to outer face 52 of mounting plate 51. Specifically, handle 66 includes a main section 70 and first and second ends 68 on opposite sides of main section 70 and spaced along third axis Z. Each of first and second ends 68 of handle 66 includes a screw hole 74, 76. Each of first and second ends 68 of handle 66 further includes two protrusions 72 on opposite sides of each screw hole 74, 76. A screw 122 is extended through hole 90 of second sidewall 82 of frame 78 and through-hole 56 of mounting plate 51 into screw hole 74 of first end 68 of handle 66. Furthermore, a fastener 64 is extended through fixing hole 60 of mounting plate 51 into screw hole 76 of second end 68 of handle 66, fixing handle 66 to outer face 52 of mounting plate 51 and fixing frame 78 to inner face 53 of mounting plate 51. It can be appreciated that protrusions 72 on first end 68 of handle 66 are securely engaged in engaging slots 58 on opposite sides of through-hole 56 of mounting plate 51 and recesses 88 of frame 78 and that protrusions 72 on second end 68 of handle 66 are securely engaged in engaging slots 58 on opposite sides of fixing hole 60, preventing frame 78 from pivoting about an axis defined by screw 122. Opening 83 of frame 78 is aligned with window 54 of mounting plate 51 after mounting frame 78 to mounting plate 51.

According to the preferred form shown, operating device 12 further includes a push member 92 having a push section 94 and a pivotal section 96 spaced from push section 94 along first axis X. In the most preferred form shown, push member 92 includes first and second lateral walls 98 spaced along second axis Y. Each of first and second lateral walls 98 includes first and second ends 103 and 105 spaced along first axis X. Push member 92 further includes an interconnecting wall 100 between first ends 103 of first and second lateral walls , 98, defining a space 102 between interconnecting wall 100 and first ends 103 of first and second lateral walls 98. First ends 103 of first and second lateral walls 98 include aligned pivot holes 106 and aligned sliding grooves 110 spaced from pivot holes 106 along third axis Z. First ends 103 of first and second lateral walls 98 further include aligned actuating pin holes 108. Each sliding groove 110 is intermediate one of pivot holes 106 and one of actuating pin holes 108 along third axis Z. First ends 103 of first and second lateral walls 98 form pivotal section 96, and second ends 105 of first and second lateral walls 98 form push section 94. Each sliding groove 110 includes first and second ends 112 and 114 spaced along first axis X. An actuating pin 120 is mounted between first ends 103 of first and second lateral walls 98 and includes two ends respectively received in pivot holes 106. A first pivot 116 is extended through first holes 84 of frame 78 and pivot holes 106 of pivotal section 96 of push member 92. A second pivot 118 is extended through second holes 86 of frame 78 and sliding grooves 110 of pivotal section 96 of push member 92 and movable between first and second ends 112 and 114 of sliding grooves 110. Thus, push member 92 is pivotably received in frame 78 with actuating pin 120 intermediate and spaced from the first sidewalls 80 of frame 78. Push section 94 extends out of receiving space 28 of door 20 and through one of slots 34 to a position abutting one of slides 40. By such an arrangement, push member 92 is pivotable between first and second positions about a first pivot axis defined by first pivot 116, second pivot 118 is in first ends 112 of sliding grooves 110 when pushing member 92 is in the first position, and second pivot 118 is in second ends 114 of sliding grooves 110 when push member 92 is in the second position.

According to the preferred form shown, operating device 12 further includes a lever 124 having first and second ends 126 and 128. A lug 130 is formed on second end 128 of lever 124 and includes first and second pin holes 132 and 134 spaced along third axis Z. Lug 130 extends through window 54 of mounting plate 51 and opening 83 of frame 78 into space 102 of push member 92. Second pivot 118 extends through first pin hole 132 of lever 124, allowing pivotal movement of lever 124 between an upper position and a lower position about a second axis defined by second pivot 118. Actuating pin 120 extends through second pin hole 134 of lever 124. Thus, lever 124 is operably connected to actuating pin 120, such that pivotal movement of lever 124 causes movement of push member 92. Specifically, actuating pin 120 drives push member 92 to pivot when lever 124 pivots between the upper and lower positions, which will be described in detail hereinafter.

Figure 7:
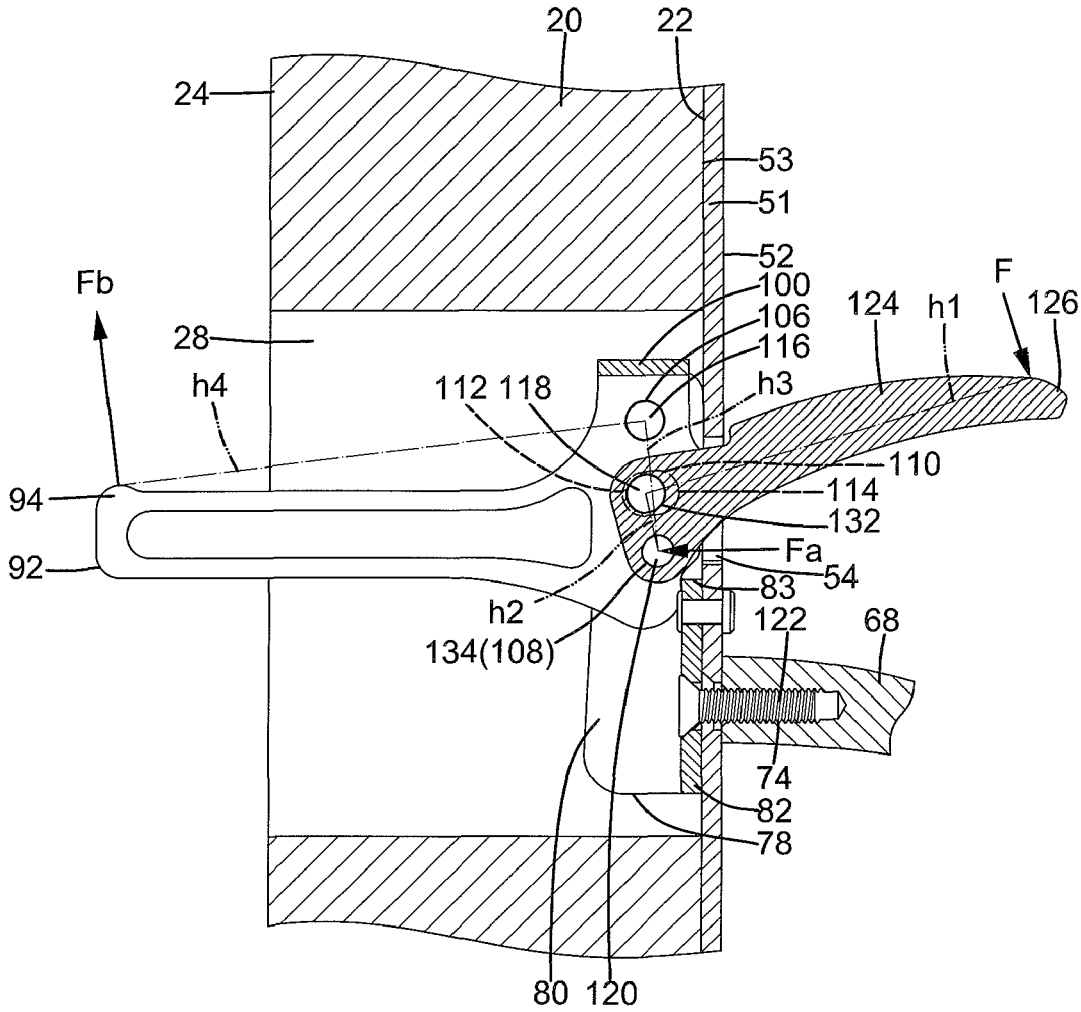
FIG. 7 shows an enlarged view of a portion of the panic exit door and the lock of FIG. 5.

After assembly, second pivot axis defined by second pivot 118 has a first spacing h1 to first end 126 of lever 124, and second pivot axis has a second spacing h2 to a center of second pin hole 134. Furthermore, first pivot axis defined by first pivot 116 has a third spacing h3 to the center of second pin hole 134, and first pivot axis has a fourth spacing h4 to push section 94. Second spacing h2 is smaller than third spacing h3, which is smaller than first spacing h1, which, in turn, is smaller than the fourth spacing h4 (FIG. 7).

Figure 8:
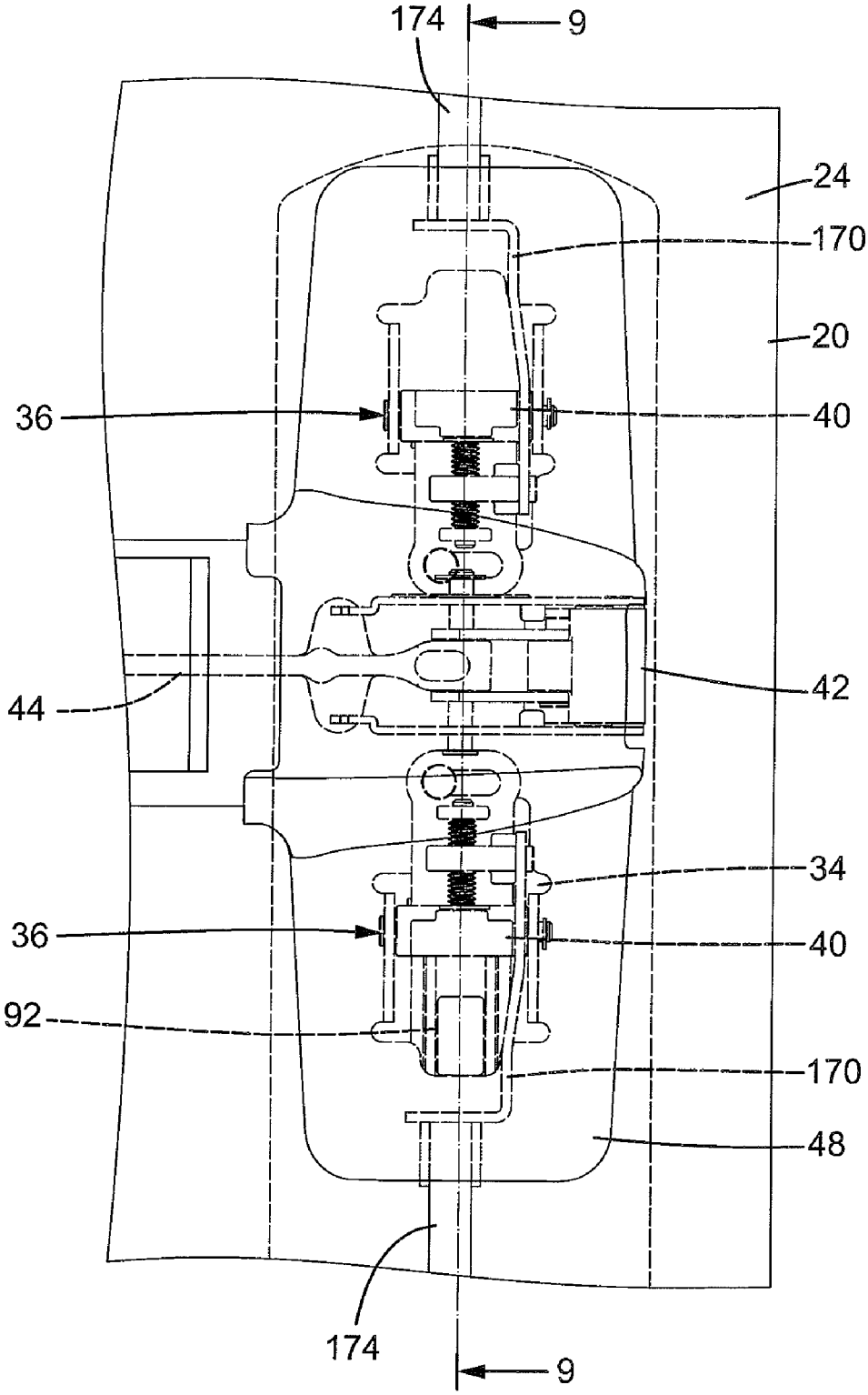
FIG. 8 shows a side view similar to FIG. 4 with a latch in a retracted position.
Figure 9:
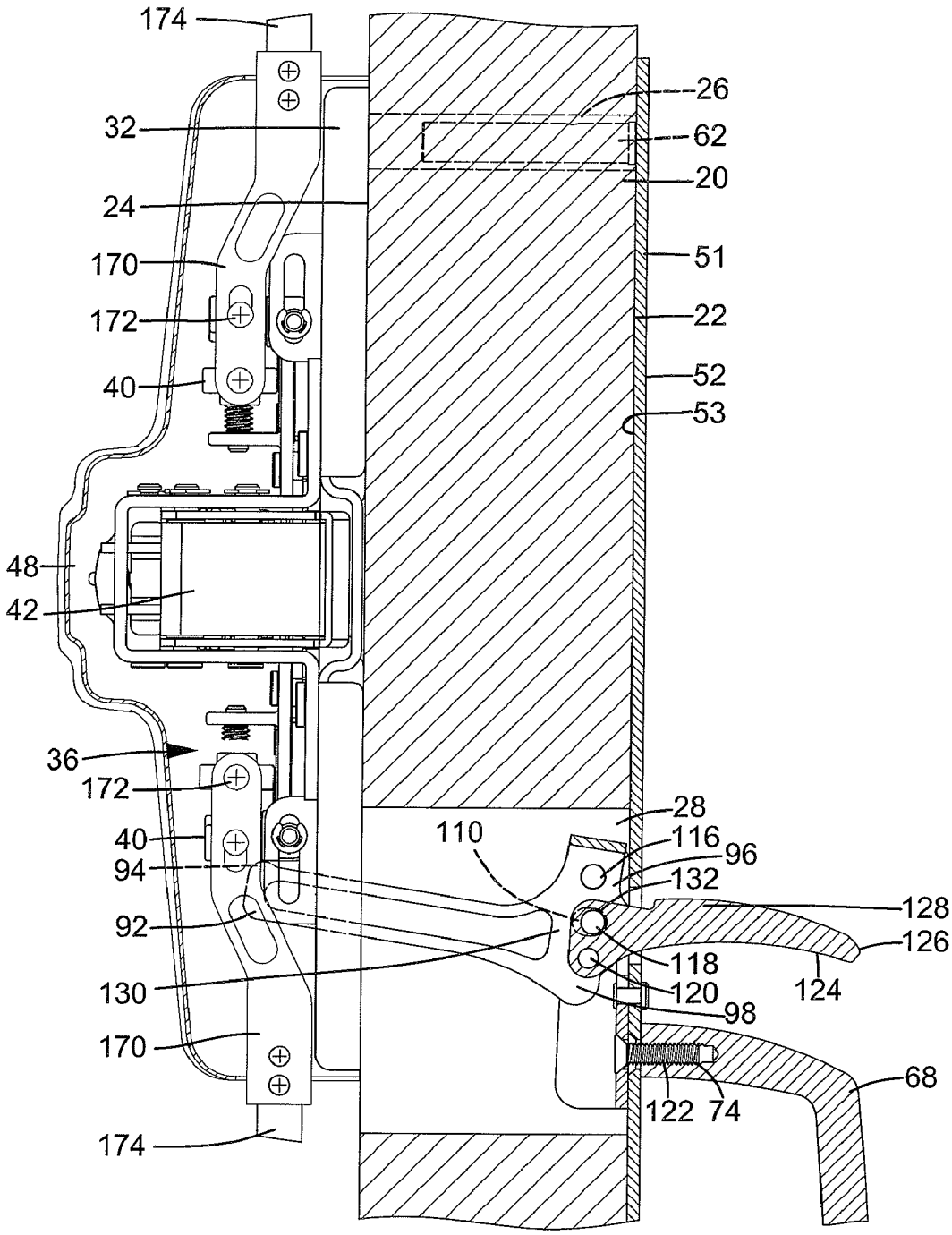
FIG. 9 shows a partial, cross sectional view of the panic exit door and the lock of FIG. 8 according to section line 9-9 of FIG. 8.
Figure 10:
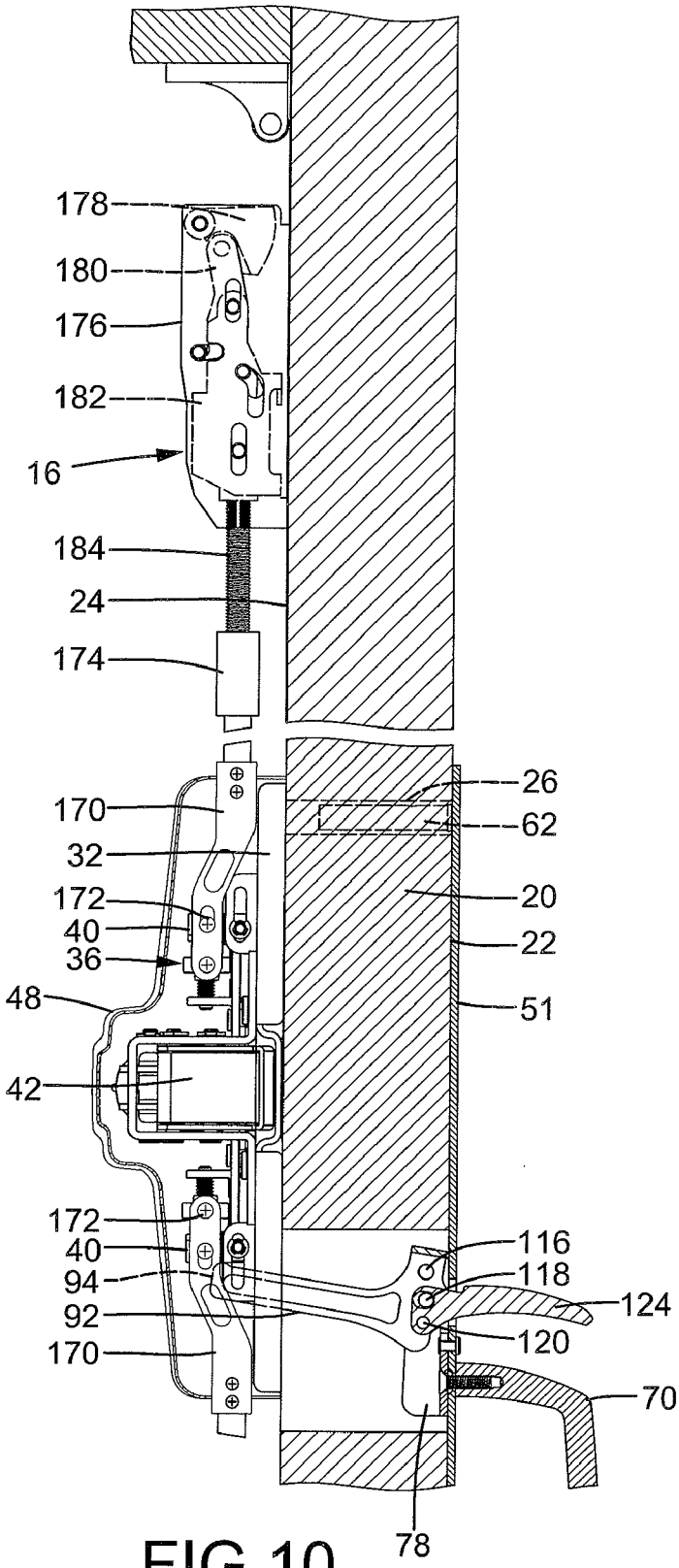
FIG. 10 shows a view similar to FIG. 6 with a top latch in a retracted position.
Figure 11:
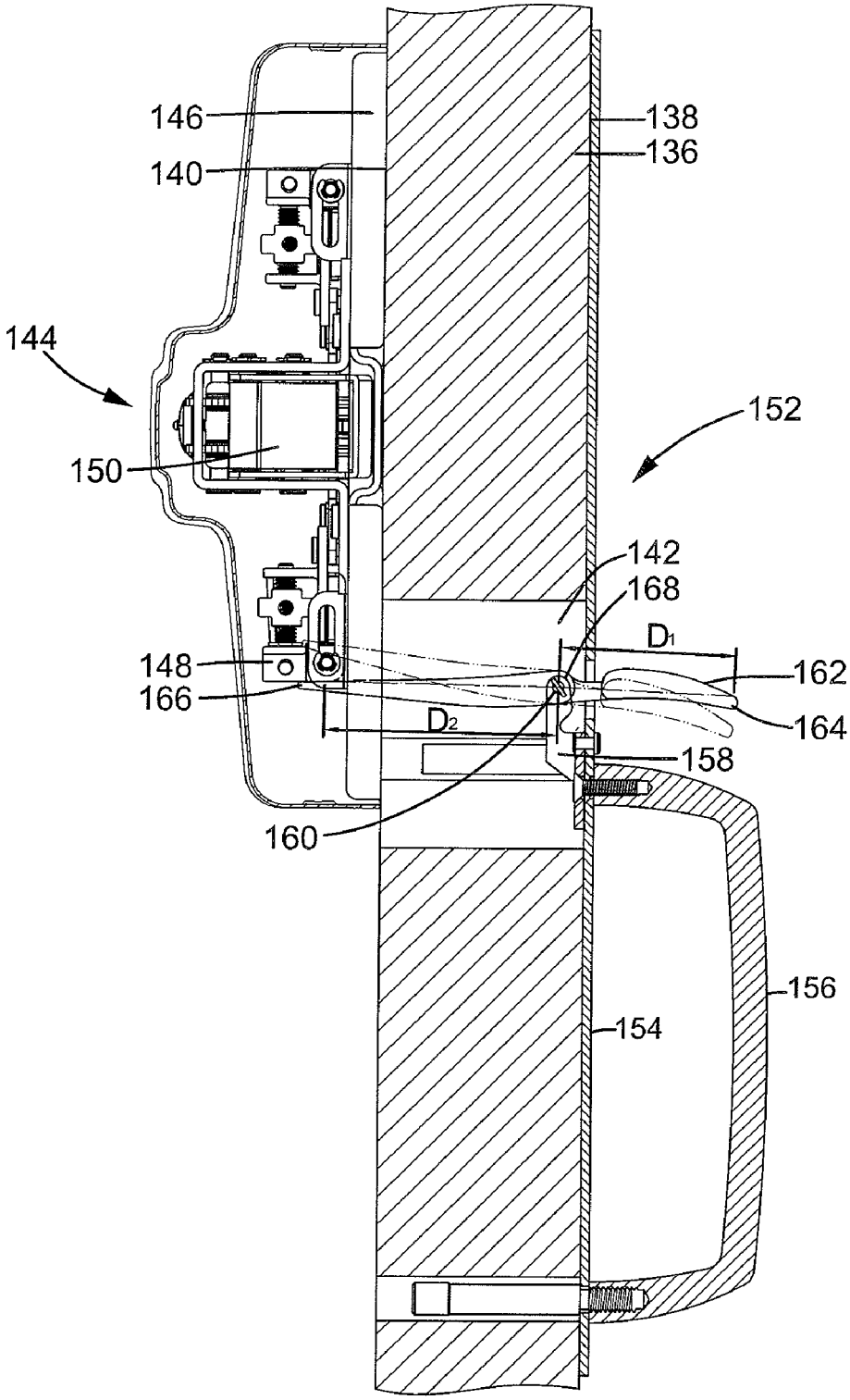
FIG.11 PRIOR ART
FIG. 11 shows a partial, cross sectional view of a panic exit door, a lock, and a conventional operating device.

Now that the basic construction of operating device 12 of the preferred teachings of the present invention has been explained, the operation and some of the advantages of operating device 12 can be set forth and appreciated. In particular, for the sake of explanation, it will be assumed that latches 42 and 178 are in their extended, locking positions (FIG. 3-6) and lever 124 is in the upper position. An end wall of first end 112 of each sliding groove 110 abuts second pivot 118. When lever 124 is moved from the upper position to the lower position, push member 92 moves from the first position to the second position, and push section 94 operates to move latches 42 and 178 from the extended, locking positions to the retracted, unlocking positions (FIGS. 8-10). Specifically, actuating pin 120 is pushed to pivot push member 92 from the first position to the second position about the first pivot axis defined by first pivot 116 when lever 124 is moved from the upper position to the lower position. Second pivot 118 moves to a position abutting an end wall of second end 114 of each sliding groove 110. Push section 94 of push member 92 pushes one of slides 40 during pivotal movement of push member 92, such that links 46 and connecting members 170 are moved. Each connecting member 170 moves one of latches 178 to the retracted, unlocking position via one of connecting rods 174. Furthermore, linking rod 44 is also moved along second axis Y in an unlatching direction to retract latch 42 to the retracted, unlocking position. Thus, door 20 can be opened by pulling handle 66.

It can be appreciated that lever 124 pivots about the second axis defined by second pivot 118 to provide a first, force-saving fulcrum effect, while pushing member 92 pivots about the first pivot axis defined by first pivot 116 to provide a second fulcrum effect by providing first, second, third, and forth spacings h1, h2, h3, and h4. Specifically, when a user applies an initial force F on first end 126 of lever 124, a force Fa is exerted on actuating pin 120. Fa is equal to (F×h1)/h2. If the angle difference (about 6°) between second and third spacings h2 and h3 is neglected, the final push force Fb at push section 94 of push member 92 can be obtained by the following equation.

$$Fb=(Fa\times h3)/h4=(F\times h1\times h3)/(h2\times h4)$$

According to the preferred form shown, first spacing h1 is about 49.2 mm, second spacing h2 is about 7.5 mm, third spacing h3 is about 16.7 mm, and fourth spacing h4 is about 67 mm. When a user applies an initial force F of approximately 3.6 kg, a final push force Fb of approximately 6 kg can be obtained to push slide 40. Thus, a force-saving effect is obtained without the need of excessive protrusion of lever 124 away from door 20.

Now that the basic teachings of the present invention have been explained, many extensions and variations will be obvious to one having ordinary skill in the art. For example, operating device 12 according to the preferred teachings of the present invention can be utilized with only one or two of latches 42 and 178. As an example, latch 42 can be removed if desired. In another example, latches 178 and corresponding elements including connecting members 170, connecting rods 174, bodies 176, linking members 180, followers 182, and screw rods 184 can be removed when only latch 42 is required. In the case latches 178 are not utilized, second ends 105 of lateral walls 98 forming push section 94 do not have to be spaced from each other. Namely, second ends 105 of lateral walls 98 can be integrally formed as a single continuous piece. Further, lateral walls 98 of push member 92 do not have to include actuating pin hole 108, and lug 130 of lever 124 does not have to include second pin hole 134. Furthermore, actuating pin 120 can be replaced by a protrusion or the like formed on an inner face of one or both of lateral walls 98. The protrusion can be actuated by an outer face of lug 130 of lever 124 when lever 124 is moved from the upper position to the lower position, achieving the same unlocking operation.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. An operating device for a lock, with the operating device comprising:

a mounting plate including inner and outer faces spaced from each other along a first axis, with a window extending from the inner face through the outer face of the mounting plate along the first axis, with the mounting plate adapted to be mounted to an outer side of a door, with a receiving space extending from an inner side of the door through the outer side of the door and having an outer end covered by the mounting plate, with the window being aligned with and in communication with the receiving space;

a frame adapted to be received in the receiving space of the door, with the frame including two first sidewalls spaced from each other along a second axis perpendicular to the first axis, with the frame further including a second sidewall extending between the two first sidewalls, with the second sidewall of the frame fixed to the inner face of the mounting plate, with the two first sidewalls including two aligned first holes and two aligned second holes, with each of the two aligned second holes spaced from one of the two aligned first holes along a third axis perpendicular to the first and second axes;

a push member including a push section and a pivotal section spaced from the push section along the first axis, with the pivotal section including a pivot hole with the aligned with the two aligned first holes, with the pivotal section further including a sliding groove aligned with the two aligned second holes, with the sliding groove including first and second ends spaced from each other along the first axis, with an actuating pin mounted to the pivotal section and spaced from the sliding groove along the third axis, with the actuating pin intermediate the two first sidewalls of the frame, with a first pivot extending through the two first holes and the pivot hole, with a second pivot extending through the two second holes and the sliding groove and movable between the first and second ends of the sliding groove, with the push section extending out of the receiving space and adapted to be operably connected to a latch movable between an extended, locking position not allowing opening of the door and a retracted, unlocking position allowing opening of the door, with the push member pivotable between first and second positions about a first pivot axis defined by the first pivot, with the second pivot being in the first end of the sliding groove when the pushing member is in the first position, with the second pivot being in the second end of the sliding groove when the push member is in the second position;

a lever including first and second ends spaced from each other along the first axis, with a lug formed on the second end of the lever and extending through the window into the receiving space of the door, with the lug including a first pin hole, with the second pivot extending through the first pin hole, allowing pivotal movement of the lever between an upper position and a lower position about a second axis defined by the second pivot, with the lever operably connected to the actuating pin, such that pivotal movement of the lever causes movement of the push member;

wherein when the lever moves from the upper position to the lower position, the actuating pin drives the push member to pivot from the first position to the second position when the lever is pivoted from the upper position to the lower position, and the push section operates to move the latch from the extended, locking position to the retracted, unlocking position.

2. The operating device as claimed in claim 1, with the push member including first and second lateral walls spaced from each other along the second axis, with each of the first and second lateral walls including first and second ends spaced from each other along the first axis, with the push member further including an interconnecting wall between the first ends of the first and second lateral walls, defining a space between the interconnecting wall and the first ends of the first and second lateral walls, with the first ends of the first and second lateral walls forming the pivotal section, with the second ends of the first and second lateral walls forming the push section, with the first end of each of the first and second lateral walls including the pivot hole and the sliding groove, with the first ends of the first and second lateral walls including two aligned actuating pin holes, with the sliding groove of the first end of each of the first and second lateral walls intermediate the pivot hole and the actuating pin hole of the first end of one of the first and second lateral walls along the third axis, with the actuating pin having two ends received in the two actuating pin holes, with the lug of the lever including a second pin hole through which the actuating pin extends.

3. The operating device as claimed in claim 2, with the second pivot axis defined by the second pivot having a first spacing to the first end of the lever, with the second pivot axis having a second spacing to a center of the second pin hole, with the first pivot axis defined by the first pivot having a third spacing to the center of the second pin hole, with the first pivot axis having a fourth spacing to the push section, with the second spacing being smaller than the third spacing, with the third spacing being smaller than the first spacing, with the first spacing being smaller than the fourth spacing.

4. The operating device as claimed in claim 3, further comprising: a handle including a main section and first and second ends on opposite sides of the main section, with the first and second ends of the handle and spaced from each other along the third axis with each of the first and second ends of the handle including a screw hole, with a screw extending through the second sidewall of the frame and the mounting plate into the screw hole of the first end of the handle, with a fastener extending through the mounting plate into the screw hole of the second end of the handle, fixing the handle to the outer face of the mounting plate and fixing the frame to the inner face of the mounting plate.

5. The operating device as claimed in claim 4, with each of the first and second ends of the handle further including two protrusions on opposite sides of each of the screw holes, with the mounting plate including two first engaging slots and two second engaging slots, with each of the two second engaging slots spaced from each of the two first engaging slots along the third axis further including two recesses, with the two protrusions of the first end of the handle securely engaged in the two first engaging slots and the two recesses of the frame, with the two protrusions of the second end of the handle securely engaged in the two second engaging slots, preventing the frame from pivoting about an axis defined by the screw.

6. The operating device as claimed in claim 4, with the second sidewall of the frame including an opening aligned with the window, with the lug of the lever extending through the opening into the space of the push member.

* * * * *